US005952434A

United States Patent [19]

Sokolova et al.

[11] Patent Number: 5,952,434

[45] Date of Patent: Sep. 14, 1999

[54] SPINNING DOPE AND FIBRES SPUN THEREFROM

[75] Inventors: Tatyana Sergeevna Sokolova, Moscow; Vera Dmitrievna Kalmykova, Mytischi; Vera Nikolaevna Sheptukhina, Jubileiny; Ljudmila Dmitrievna Serova, Jubileiny; Tatyana Andreevna Rozhdestvenskaya, Jubileiny; Vladimir Nikolaevich Kiya-Oglu; Alexandra Vasilievna Volokhina, both of Mytischi; Ljubov Yakovlevna Tikanova, Moscow; Georgy Ivanovich Kudryavtsev, deceased, late of Mytischi, all of Russian Federation, by Ljudmila Georgievna Kudryavtseva, administrator

[73] Assignee: Vserossiisky Nauchno-Issledovatedlsky Institut Polimernykh Volokon S Opytnym Zavodom (Vniipv), Ultisa Kolontsova, Russian Federation

[21] Appl. No.: 08/930,891

[22] PCT Filed: Mar. 30, 1995

[86] PCT No.: PCT/RU95/00057

§ 371 Date: Jan. 9, 1998

§ 102(e) Date: Jan. 9, 1998

[87] PCT Pub. No.: WO96/30569

PCT Pub. Date: Oct. 3, 1996

[51] Int. Cl.[6] ..... C08L 77/00

[52] U.S. Cl. ..... 525/432; 525/434; 264/178 F; 264/184

[58] Field of Search ..... 525/432, 434; 264/178 F, 184

[56] References Cited

U.S. PATENT DOCUMENTS 5,011,643 4/1991 Yang ..... 264/184
5,366,781 11/1994 Coburn et al. ..... 428/113

FOREIGN PATENT DOCUMENTS 0392558 10/1990 European Pat. Off. .
2008598 6/1979 United Kingdom .
2160878 1/1986 United Kingdom .

OTHER PUBLICATIONS

Fibre Chemistry, vol. 20, No. 6, Jun. 1989 New York, US, pp. 410–412, A.V. Volokhina et al. "Preparation of Polyamide Fibres from Liquid–Crystal Solutions of Mixtures of Rigid–and Flexible–Chain Polymers".

Fibre Chemistry, vol. 19, No. 4, Mar. 1988 New York, US, pp. 270–273, M.M. Iovleva et al. "Structural Features from Mixtures of Rigid–and Flexible–Chain Polymers from Data of Electron Microscope and Sorption Methods".

Fibre Chemistry, vol. 18, No. 3, Jan. 1987 New York, US, pp. 155–161, A.V. Volokhina "Fibres from Mixtures of Rigid–Chain and Flexible–Chain Polymers".

Fibre Chemistry, vol. 16, No. 4, Mar. 1985 New York, US, pp. 266–268, A.V. Volokhina et al. "Effect Of The Chemical Structure of Introduced Polymers on the Properties of Poly–p –Phenyleneterephthalamide Solutions".

Database WPI, Section CH, Week 8433 Derwent Publications Ltd., London, GB; Class A23, AN 84–204017 & JP, A59 116 411 (ASAHI Chemical Ink KK), Jul. 5, 1984.

Database WIP Section CH, Week 8443 Derwent Publications Ltd., London, GB; Class A23, AN 84–266791 & JP,A,59 163 418 (ASAHI Chemical IND KK), Sep. 14, 1984.

*Primary Examiner*—Veronica P. Hoke
*Attorney, Agent, or Firm*—Ladas & Parry

[57] ABSTRACT

The invention relates to synthetic yarns spun from suophuric acid anistropic solutions of rigid aromatic polyamides blended with aliphatic polyamides. Disclosed is a spinning dope composition comprising an aromatic polyamide, an aliphatic polyamide and concentrated sulphuric acid, wherein at least one of the aromatic and aliphatic plyamides is a copolymer composed of two aromatic and two aliphatic homopolymer units, respectiveyl; the aromatic copolymer having the formula: [~~(~~(HN $C_6H_4$—HH CO $C_6H_4$CO~~)u~~—(NH $C_6H_4$NH CONH $C_6H_4$NH CO $C_6H_4$CO~~)w~~], wherein u=75–95 wt. % and w=5–25 wt. % and the aliphatic copolymer has the formula [~~(~~HN$(CH_2)_6$—NHCO$(CH_2)_4$CO~~)n~~—(HN$(CH_2)_5$CO~~)m~~ wherein n=95–50 wt. % and m=5–50 wt. %.

9 Claims, No Drawings

SPINNING DOPE AND FIBRES SPUN THEREFROM

The invention relates to the field of making synthetic yarns, in particular to synthetic yarns spun from sulphuric acid anisotropic solutions of rigid chain aromatic polyamides blended with aliphatic polyamides.

Spinning dopes of sulphuric acid and aromatic and aliphatic polyamides, and fibres made thereof, are known from Japanese laid open No. 59163418-A, in which a spinning dope composed of 80–99 wt. % poly(p-phenylene terephthalamide) and 1–20 wt. % aliphatic polyamide is described. The fibres prepared from said dope are particularly suitable for making paper.

In EP 392558 a biphasic solution (dope) of para-aramid polymer and a polymer that can be thermally consolidated, like polyhexamethylene adipamide or poly(E-caproamide), is mentioned. The fibres made thereof are considered suitable for the preparation of thermally shaped objects (prepregs).

Although poly(p-phenylene terephthalamide) fibres are known to have very high thermal stability and very high strength, there is a need to improve their other characteristics. In the prior art, such other characteristics were enhanced by the use of blends. However, this, in its turn, was found to result in a reduction of other beneficial properties of the fibres, such as their strength and/or abrasion resistance.

It was found that by the use of a spinning dope according to the present invention, improved physical properties could be obtained without a significant loss of other beneficial properties. Such improvement was obtained by the use of a spinning dope composition comprising an aromatic and an aliphatic polyamide and concentrated sulphuric acid, and is characterized in that at least one of the aromatic and aliphatic polyamides is a copolymer built up of two aromatic and two aliphatic polymer units, respectively, the aromatic copolymer having the formula
(formula I):

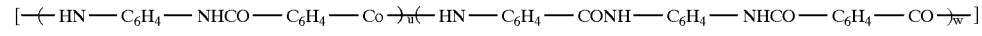

wherein u=75–95 wt. %, preferably 80–90 wt. % and w=5–25 wt. %, preferably 10–20 wt. %.
and the aliphatic copolymer having the formula
(formula II):

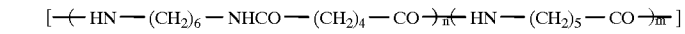

wherein n=95–50 wt. %, preferably 93–60 wt. %, and m=5–50 wt. %, preferably 7–40 wt. %.

Very good results are obtained if use is made of a spinning dope according to the above invention in which about 16–19.4 wt. % of the aromatic polyamide, 0.6–4.0 wt. % of the aliphatic polyamide, and up to 100 wt % of concentrated sulphuric acid are present. Such a spinning dope can be prepared by the method described in European Patent No. 021484, which is incorporated by reference.

In order to avoid a solution of aliphatic and aromatic (co)polyamides being separated into two phases, i.e. an anisotropic and an isotropic phase, thorough agitation of the solution prior to processing is considered necessary, in particular if the polymer blend in the solution comprises more than 12 wt. % of aliphatic polyamides based on the total amount of polymer in the solution.

In Japanese patent application JP 59/116411-A it is described that adhesion to rubber and other materials, usually a finish coating is applied. By adding an aliphatic polyamide polymer to the spinning dope of poly(p-phenylene terephthalamide), an increase in adhesion is obtained. However, such an addition is attended with a significant drop in strength. By using a spinning dope of poly(p-phenylene terephthalamide), an aliphatic polymer of formula II, and sulphuric acid it is possible to make fibres or yarns which are very suitable for making reinforced and self-reinforced plastics and reinforced rubber technical articles, in particular cord for reinforcing automobile tires.

By spinning a spinning dope of sulphuric acid, poly(p-phenylene terephthalamide) and more than 5 wt. % of a common aliphatic polymer based on the total polymer amount present, fibres are obtained which show a considerable drop of (up to 28%) or even more in fibre strength as compared with the poly(p-phenylene terephthalamide) fibre strength. As is further exemplified by the test results of spinning fibre blends of poly(p-phenylene terephthalamide) and a formula II copolymer, the drop in fibre strength is much less severe. On the other hand, when using such a blend an increase in fibre adhesion can be obtained compared with poly(p-phenylene terephthalamide) fibres. According to this preferred embodiment, the aliphatic copolyamide is preferably applied in amounts of between 3 and 20 wt. %, based on the total amount of polymer present.

From UK Patent Application GB 2 160 878 it is known to dissolve a mixture of a poly(p-phenylene terephthalamide) polymer and an aromatic-aliphatic copolyamide in concentrated sulphuric acid to obtain fibres of increased tenacity and modulus. The drawback to this method is the necessity of incorporating into the blend up to 15 wt. % of aromatic-aliphatic copolyamide, the production of which is very difficult, at any rate more difficult than that of poly(p-phenylene terephthalamide). Furthermore, the fibre density is not lowered, contrary to what has been found with the use of spinning dopes according to the present invention.

Furthermore, the abrasion resistance of fibres made from the spinning dopes described in the prior art is not always as high as desired. The abrasion resistance of the fibres obtained from a spinning dope comprising an aromatic copolyamide of formula I and an aliphatic copolyamide of formula II was found to be superior to that of prior art fibre compositions and fibres substantially comprising poly(p-phenylene terephthalamide) polymer.

Unexpectedly, it was found that when introducing the above-mentioned aliphatic copolyamide of formula II at a certain component ratio gives a sharp increase in yarn strength and yarn abrasion resistance. The mechanism for strengthening the yarns of the blends indicated above apparently is different from that when mixing aromatic-aliphatic additive with poly(p-phenylene terephthalamide) as in UK Patent Application GB 2 160 878, since the aliphatic copolyamide cannot be built into the crystal lattice of poly(p-phenylene terephthalamide), and thus is not.

By use of the aliphatic copolyamide of formula II, up to 8 mass % with the remaining polymer amount of 92 wt. % being poly(p-phenylene terephthalamide), provides a yarn which has a strength of up to 2010–2059 mN/tex, whereas a comparable yarn of poly(p-phenylene terephthalamide) polymer has a strength of about 2059 mN/tex. The yarn strength is increased when, together with the aliphatic copolyamide of formula II, an aromatic copolyamide of formula I is applied. Compared with the same poly(p-phenylene terephthalamide) fibre strength of 2059 mN/tex, a yarn strength of 2255 up to 2450 mN/tex was found.

At a higher concentration of aliphatic copolyamide in the polymer blend (up to 20 wt. %), the decrease of the yarn strength as compared with aliphatic polyamides such as polycaproamide or polyhexamethylene adipamide or a blend thereof is lower.

The amount of incorporated aliphatic copolyamides is 3–20 wt. % of the polymer blend.

The addition of less than 3 wt. % of aliphatic copolyamides does not considerably affect the yarn properties. The addition of more than 20 wt. % of such an aliphatic polyamide, however, results in a reduced tenacity, which is not considered acceptable for each and every application of the fibres.

The fibre strength is found not to decrease when is use is made of a blend of an aromatic copolyamide of the formula I and an aliphatic polyamide such as polycaproamide or polyhexamethylene-adipamide (PA 6 and PA 66), contrary to what was found if a common PPDT (poly[p-phenylene terephthalamide]) and such an aliphatic polyamide were applied. Moreover, the fibres made of the now found composition were found to have a low density, which is considered favourable in applications where both a low density and a very high yarn strength are required. This is in particular the case when the fibres are used for making reinforced plastics, reinforced rubber articles, and heat-insulation materials.

Hence, the invention also encompasses a spinning dope of an aromatic copolyamide of one of the formulae I, an aliphatic polyamide comprising a component chosen from PA 6, PA 66, or a copolymer thereof, and concentrated sulphuric acid.

A very beneficial spinning dope and fibres spun therefrom result when a spinning solution of an aromatic copolyamide according to one of the formulae I is used together with an aliphatic copolyamide according to formula II and concentrated sulphuric acid. The spinning dope preferably comprises 16–18.5 wt. % of the aromatic copolyamide, 1.5–4.0 wt. % of aliphatic copolyamide, and a balance amount of sulphuric acid.

The invention is further illustrated by the examples given below. In these examples, the inherent viscosity IV which is defined as IV=ln ($\eta_{rel}$)/c, in which c is the concentration, was determined by a viscometric method on solutions containing 0,5 g of polymer in 100 ml of 96% sulphuric acid at 25° C.

Complex yarn strength having optimum twist were determined by clamping a length of 500 mm yarn on an Instron tensile tester according to standard procedures known in the art for such tensile testers.

EXAMPLE 1

A 20%-dope was prepared in reactor with a capacity of 63 liters. To this end, 9.5 kg (19 wt. %) of aromatic copolyamide of formula I wherein u=90 and w=10 wt. % and with an inherent viscosity IV of 5.5 dl/g, 0.5 kg (1 wt. %) of aliphatic copolyamide of formula II wherein n=80 and m=20 wt. % and with an inherent viscosity IV of 1.2 dl/g, and 21.9 l (80 wt. %) of 99.9%-sulphuric acid solution were fed, under vacuum, to a filtration step while being mixed at a temperature of 75° C., and then to the spinning machine. Spinning was carried out by a dry-wet method through an air gap of about 10 mm, into a 10%-sulphuric acid spinning bath having a temperature of 8° C. The take-up yarn rate was 85 m/min, and the cup spinnerets of precious metal had a cup diameter of 28 mm, the number of holes being 1000 and the hole diameter being 0,07 mm. The draw ratio of the dope stream in the air gap was 8.1.

At the spinning machine the yarn was subjected to a washing step under a tension of 20–60 mN/tex. Further acid neutralization took place using an 0.02% solution of sodium hydroxide. Next, the yarn was dried at about 120°–150° C. and taken up by a take-up device without any twist being applied after the spinning. The IV viscosity of the polymer blend in the yarn was 4.8 dl/g. The yarn was subjected to a twist of up to 80 twists per meter. The yarn's linear density was 167 tex, the tensile strength 2255 mN/tex, and the elongation at break 4.3%. The abrasion resistance was found to amount to 23 thousand cycles.

EXAMPLE 1A

The tensile strength of yarn being spun, under similar conditions to those indicated in Example 1, from a 20% solution of the same aromatic copolyamide as used in Example 1, and in the same way as indicated in Example 1, but this time without the addition of an aliphatic copolyamide to the solution was 2010 mN/tex. The abrasion resistance was 14 thousand cycles.

EXAMPLE 1B

A yarn was spun by the same procedure as indicated in Example 1, with the same amount of the aromatic copolyamide of formula I being applied. Instead of the aliphatic polyamide of formula II, this time a similar amount of polycaproamide with an inherent viscosity IV of 1.2 dl/g was incorporated into the blend in the same way, and the yarn was spun under conditions similar to those of Example 1. The yarn obtained showed a tensile strength of 1990 mN/tex and an abrasion resistance of 12 thousand cycles. The adhesion was found to be superior to that of the yarns obtained in Example 1A.

EXAMPLES 2–7

Several spinning dopes were prepared, use being made of different dope compositions and polymers of a different structure. The 20 wt. % polymer-containing spinning dopes were prepared by mixing the polymer components with a 99.8%-sulphuric acid solution. After 4 hours of stirring in a mixer at 75° C. the obtained anisotropic solution was fed, under vacuum, to a filter and subsequently to the spinning machine. The spinning of the yarns was carried out in the manner described in Example 1. The tensile strength of the yarns and their abrasion resistance were measured and are indicated in Table I. The specification and the amount of each of the polymers used are also indicated in Table I.

The aromatic copolyamide is the copolyamide according to formula I. The inherent viscosity IV of the aromatic polyamide used was between 5.4 and 5.5 dl/g, the viscosity of the different aliphatic polyamides used was 1.2 dl/g.

TABLE

| Example Nos | Aromatic copolyamide [u/w] | Aliphatic (co)polyamide [n/m] | Dope Composition aromatic copolyamide/ aliphatic copolyamide/$H_2SO$ [wt. %] | Yarn tensile strength [mN/tex] | Abrasion resistance [thousand cycles] |
|---|---|---|---|---|---|
| 2A | 90/10 | 85/15 | 19/1/80 | 2451 | 25 |
| 2B | 90/10 | polycaproamide | 19/1/80 | 2059 | 12 |
| 3A | 90/10 | 85/15 | 18/2/80 | 2255 | 22 |
| 3B | 90/10 | polyhexamethylene adipamide | 18/2/80 | 2010 | 10 |
| 4A | 90/10 | 85/15 | 16/4/80 | 1863 | 18 |
| 4B | 90/10 | polycaproamide | 16/4/80 | 1716 | 12 |
| 4C | 90/10 | 50/50 | 16/4/80 | 1765 | 15 |
| 5A | 85/15 | 85/15 | 19/1/80 | 2451 | 25 |
| 5B | 85/15 | polycaproamide | 19/1/80 | 2059 | 12 |
| 5C | 85/15 | without aliphatic PA | 20/—/80 | 2059 | 14 |
| 6A | 75/25 | 93/7 | 19.4/0.6/80 | 2157 | 20 |
| 6B | 75/25 | polycaproamide | 19.4/0.6/80 | 2108 | 10 |
| 6C | 75/25 | without aliphatic PA | 20/—/80 | 2108 | 14 |
| 7A | 75/25 | 50/50 | 16/4/80 | 1863 | 16 |
| 7B | 75/25 | polycaproamide | 16/4/80 | 1814 | 8 |

For the polymer compositions not comprising an aliphatic copolyamide according to formula II but an aliphatic polyamide homopolymer like polycaproamide or polyhexamethylene adipamide instead, a comparable tensile strength of the yarns produced therefrom was found. The fibres produced from these polymer compositions had a significantly increased adhesion compared with the compositions comprising no aliphatic polyamide at all. The superiority in characteristics of the fibres obtained from polymer compositions comprising both a formula I aromatic copolyamide and a formula II aliphatic copolyamide is clear from the above results.

EXAMPLE 8

38 g (19 wt. %) of poly(p-phenylene terephthalamide) with a viscosity of 5.8 dl/g and 2 g (1 wt. %) of an aliphatic copolyamide of formula II wherein n=85 and m=15 and with an inherent viscosity IV of 1.2 dl/g were incorporated as a blend into 87.4 ml (80 wt. %) of 99.8%-sulphuric acid, stirred in a mixer for 3 hours at 82° C., filtered, and deaerated within one hour at dissolution temperature. The spinning of the yarn was carried out in a process similar to the one described for Examples 2–7.

The viscosity of the polymer blend in the yarn was 4.8 dl/g, the yarn tensile strength was 2059 mN/tex, the elongation at break of the yarn 3.4%, and the abrasion resistance of the yarn 22 thousand cycles.

EXAMPLE 8A (COMPARATIVE)

The strength of a yarn spun from a 20% poly(p-phenylene terephthalamide) polymer-comprising solution without any aliphatic (co)polyamide was 1961 mN/tex, the abrasion resistance 10 thousand cycles.

EXAMPLE 9

36 g (18 wt. %) of poly(p-phenylene terephthalamide) and 4 g (2 wt. %) of an aliphatic copolyamide of formula II wherein n=85 and m=15 (viscosity IV=1.2 dl/g) were incorporated as a blend into 87.4 ml (80 wt. %) of a 99.8%-sulphuric acid solution, stirred in a mixer at 82° C. for 3 hours, filtered, and deaerated at dissolution temperature within 1 hour. The spinning of the yarn was carried out as described in Example 10. The inherent viscosity IV of the polymer blend in the yarn is 4.8 dl/g. The tensile strength was 1961 mN/tex, the elongation at break 3.3%, and the abrasion resistance 20 thousand cycles.

EXAMPLE 9A (COMPARATIVE)

On repeating Example 9, except that polycaproamide and polyhexamethylene adipamide, both with an inherent viscosity IV of 1.2 dl/g, were used instead of an aliphatic copolyamide according to formula II, the resulting yarns showed a tensile strength of about 1441 mN/tex and an abrasion resistance of 8 thousand cycles. The solution from which these yarns were made had the following composition: 18.4/1.6/80 wt. % (poly(p-phenylene terephthalamide)/PA 6 or PA 6.6/sulphuric acid).

EXAMPLE 10

18.5 wt. % of an aromatic copolyamide according to formula I wherein u=90 and w=10 and with an inherent viscosity IV of 5.5 dl/g and 1.5 wt. % of polyhexamethylene adipamide with an inherent viscosity IV of 1.0 dl/g (7.5 wt. % of alipha-tic polyamide in the polymer blend) were dissolved in 43.7 ml (80 wt. %) of 99.8%-sulphuric acid solution, stirred in a mixer at 74°–78° C. for 3 hours, filtered, and deaerated at dissolution temperature within 1,5–2 hours. From the thus obtained anisotropic 20% polymer comprising spinning dope yarns were spun through a 5 mm air gap by the dry-wet spinning process for aramid fibres well-known per se in the art, into water of 10° C. and at a yarn take-up speed of 120 m/min. The stream draw ratio in the air gap was 6.0. The spinnerets used had about 100 holes and a hole diameter of 0.08 mm. The wet yarn was taken up on a bobbin and the acid washed off. Next the yarn was dried at room tem-perature and twisted up to 150 twists/meter. The viscosity IV of the polymer blend in the yarn was 5.1 dl/g. The yarn's linear density was 29.4 tex, the density 1.35 g/cm$^3$. The tensile strength of the yarn found, 2010 mN/tex, corresponds to the tensile strength of a yarn not comprising any flexible chain polymer but spun, under the same conditions, from a 20% polymer comprising solution of rigid-chain polyamide. The bending resistance of the yarn prepared was found to be 14000–16000 cycles, whereas the bending resistance of the yarn not comprising the aliphatic polyamide was 2000 cycles.

EXAMPLE 11

A 20% polymer comprising spinning dope was prepared in reactor with a capacity of 60 l. To this end were used 18 wt. % of an aromatic copolyamide according to formula I wherein u=85 and w=15 and IV=5.5, 2 wt. % of polycaproamide with an inherent viscosity IV of 1.33 dl/g (10% of aliphatic polyamide in the polymer blend), and 22 l (80 wt. %) of a 99.8%-sulphuric acid solution. After 4 hours of preparation in a mixer the obtained anisotropic solution was fed under vacuum and at 75° C., to a filter and then to the spinning machine. Spinning was carried out through an air gap of 7 mm into a 10%-sulphuric acid spinning bath of 60° C., at a yarn take-up speed of 70 m/min and through a spinneret comprising 1000 holes, the hole diameter being 0.07 mm, and the stream draw ratio in the air gap being 8.1. The yarn on the spinning machine was kept under a tension of 2.5 cN/tex and the acid was washed off, the acid residue being further neutralized. Finally, the yarn was dried at 100°–150° C.

After the application of a spin finish, the yarn was placed on a take-up device without being twisted. Next, the yarn was twisted to 80 twists/meter. The inherent viscosity IV of the polymer blend in the yarn is 4.8 dl/g. The yarn's linear density was 167 tex, the density 1.35 g/cm$^3$. The tensile strength was 2010 mN/tex, which corresponds to the tensile strength of a yarn prepared under the same conditions, from poly(p-phenylene terephthalamide) alone, i.e. not comprising any flexible chain polymers (aliphatic polyamide). The yarn's dynamic modulus of elasticity was 98066 N/mm$^2$, the elongation at break 3.5%.

EXAMPLE 12

The preparation of a spinning dope was carried out as described in Example 11, except that use was made of 17 wt. % of an aromatic copolyamide of formula I wherein u=80, w=20, and IV=5.5 dl/g together with 3 wt. % of polycaproamide with an inherent viscosity IV of 1.33 dl/g. The polymer blend thus comprised 15 wt. % of aliphatic polyamide. The inherent viscosity IV of the polymer blend in the yarn was 4.7 dl/g. The linear density was 167 tex, the density 1.26 g/cm$^3$, and the tensile strength 1765–1863 mN/tex. The dynamic modulus of elasticity was found to be 107866 N/mm$^2$, the elongation at break 3.2–3.6%. The drop in yarn strength as compared with a yarn not comprising flexible chains was found to be 7–12%.

EXAMPLE 13

A spinning dope was prepared according to the process described in Example 11, except that use was made of 16 wt. % of an aromatic copolyamide of formula I wherein u=75 and w=25 and with an inherent viscosity IV of 5.5 together with 4 wt. % of polycaproamide with IV=1.33. Thus, the polymer blend consisted of 20 wt. % of aliphatic polyamide. After some time the solution separated into an anisotropic and an isotropic phase.

The preparation of the yarns was carried out as described in Example 11. The drying of the yarn on the spinning machine was carried out at 100°–270° C. The inherent viscosity IV of the polymer blend in the yarn was 4.65 dl/g. The yarn density was 1.17 g/cm$^3$, the yarn tensile strength 1617–1716 mN/tex. The dynamic modulus of elasticity was 93157–118000 N/mm$^2$, the elongation at break 3.3–3.7%. Compared with a yarn not comprising an aliphatic polyamide (2010 mN/tex), the drop in yarn strength was about 15–20%.

EXAMPLE 14 (COMPARATIVE)

A spinning dope comprising 20 wt. % of polymer in the solution was prepared in a manner similar to that described in Example 10, except that use was made of 18.4 wt. % of poly(p-phenylene terephthalamide) (viscosity IV=5.8 dl/g) together with 1.6 wt. % of polycaproamide (IV=1.33 dl/g) and 43.7 ml (80 wt. %) of a 99.8%-sulphuric acid solution. The dope was prepared at 80°–85° C., so an anisotropic was obtained. The viscosity IV of the polymer blend in the yarn was 4.8 dl/g. The yarn's density was 1.34 g/cm$^3$, the tensile strength 1441 mN/tex (compared with a yarn strength for poly(p-phenylene terephthalamide) alone of 2010 mN/tex). The tenacity drop therefore was 30%. The yarn's bending resistance was 6000 cycles. For yarns of poly(p-phenylene terephthalamide) without any aliphatic polyamide this was found to be 1000 cycles.

EXAMPLE 15 (COMPARATIVE)

A spinning dope comprising 20 wt. % of polymer in the solution was prepared in a manner similar to that described in Example 10, except that use was made of 18.6 wt. % of poly(p-phenylene terephtalamide) (viscosity IV=5.8 dl/g) together with 1,4 wt. % of polyhexamethylene adipamide with an inherent viscosity IV of 1.33 dl/g and 43.7 ml (80 wt. %) of a 99.8%-sulphuric acid solution. The yarn density of 1.42 g/cm$^3$ was unchanged compared with the density of a poly(p-phenylene terephthala-mide) yarn not comprising an aliphatic polyamide. The tensile strength was 1441 mN/tex. The tenacity drop therefore was 30%.

We claim:

1. A spinning dope composition comprising a wholly aromatic polyamide comprising polymer units of the formula $$\text{—}\!\!\vdash(\text{HN}\text{—}\text{C}_6\text{H}_4\text{—}\text{NHCO}\text{—}\text{C}_6\text{H}_4\text{—}\text{CO})\!\!\dashv;$$

an aliphatic polyamide comprising polymer units of polycaproamide or polyhexamethylene adipamide, and concentrated sulphuric acid, wherein at least one of the aromatic and aliphatic polyamides is a copolymer of two aromatic or two aliphatic polymer units, respectively, the aromatic copolymer having the formula $$\text{—}\!\!\vdash(\text{HNC}_6\text{H}_4\text{—}\text{NHCO}\text{—}\text{C}_6\text{H}_4\text{CO})\!\!\dashv_u$$
$$\text{—}(\text{HN}\text{—}\text{C}_6\text{H}_4\text{—}\text{CONH}\text{—}\text{C}_6\text{H}_4\text{—}\text{NHCOC}_6\text{H}_4\text{—}\text{CO})\text{—}_w]$$

wherein u=75–95 wt. % and w=5–25 wt. %, and the aliphatic copolymer, in an amount of 3–20 wt. % of a blend of the aromatic and aliphatic polyamides, having the formula $$\text{—}\!\!\vdash(\text{HN}\text{—}(\text{CH}_2)_6\text{—}\text{NHCO}\text{—}(\text{CH}_2)_4\text{—}\text{CO})\!\!\dashv_n$$
$$\text{—}(\text{HN}(\text{CH}_2)_5\text{—}\text{CO})\text{—}_m]$$

wherein n=95–50 wt. % and m=5–50 wt. %.

2. Spinning dope composition according to claim 1, wherein u=80–90 wt. %, w=10–20 wt. %, n=93–60 wt. %, and m=7–40 wt. %.

3. Spinning dope composition according to claim 1, comprising 16–19.4 wt. % of a wholly aromatic polyamide, 0.6–4.0 wt. % of an aliphatic polyamide, and a balance amount of concentrated sulphuric acid.

4. Spinning dope composition according to claim 1, wherein the aromatic polyamide has the formula $$[-(HN-C_6H_4-NHCO-C_6H_4-CO)_u-(HN-C_6H_4-CONH-C_6H_4-NHCO-C_6H_4-CO)_w]$$

wherein u=75–90 wt. % and w=10–25 wt. %.

5. Spinning dope composition according to claim 3, wherein the aliphatic polyamide has the formula $$[-(HN-(CH_2)_6-NHCO-(CH_2)_4-CO)_n-(HN-(CH_2)_5-CO)_m]$$

wherein n=93–50 wt. % and m=7–50 wt. %.

6. Fibres of a blend of polyamides, the blend comprising a wholly aromatic polyamide comprising polymer units of the formula $$-[-(NH-C_6H_4-NHCO-C_6H_4-CO)-]-;$$

and an aliphatic polyamide wherein at least one of the aromatic and aliphatic polyamides is a copolymer of two aromatic or two aliphatic polymer units, respectively, the aromatic copolymer of two aromatic polymer units having the formula $$-[-HNC_6H_4-NHCO-C_6H_4CO)_u-(HNC_6H_4-CONH-C_6H_4-NHCOC_6H_4-CO)_w]$$

wherein u=75–90 wt. % and w=10 –25 wt. %,
and the aliphatic copolymer of two aliphatic polymer units having the formula $$-[-(HN(CH_2)_6-NHCO-(CH_2)_4-CO)_n-(HN(CH_2)_5CO)_m]$$

wherein n=93–50 wt. % and m=7–50 wt. %.

7. Fibres according to claim 6, wherein the aromatic polyamide has the formula $$[-(HN-C_6H_4-NHCO-C_6H_4-CO)_u-(HN-C_6H_4-CONH-C_6H_4-NHCO-C_6H_4-CO)_w]$$

wherein u=75–90 wt. % and w=10–25 wt. %.

8. Fibres according to claim 6, wherein the aliphatic copolymer has the formula $$[-(HN-(CH_2)_6-NHCO-(CH_2)_4-CO)_n-(HN-(CH_2)_5-CO)_m]$$

wherein n=93–50 wt. % and m=7–50 wt. %.

9. Yarn composed of fibres according to claim 6.

* * * * *